US005347975A

United States Patent [19]

Salansky

[11] Patent Number: 5,347,975

[45] Date of Patent: Sep. 20, 1994

[54] BALL THROWING DEVICE FOR TENNIS BALLS

[76] Inventor: Werner Salansky, Reinlgasse 5-9, A-1140 Vienna, Austria

[21] Appl. No.: 952,638

[22] Filed: Dec. 1, 1992

[30] Foreign Application Priority Data

Apr. 16, 1991 [AU] Australia ..... A801/91

[51] Int. Cl.[5] ..... F41B 4/00

[52] U.S. Cl. ..... 124/78; 124/1; 273/26 D

[58] Field of Search ..... 124/80, 81, 83, 78, 124/82, 49, 6, 10, 1, 56; 273/26 D, 29 A

[56] References Cited

U.S. PATENT DOCUMENTS

| | | | |
|---|---|---|---|
| 2,918,915 | 12/1959 | Doeg | 124/81 X |
| 4,193,591 | 3/1980 | Paulson | 273/26 D X |
| 4,563,999 | 1/1986 | Miehlich | 124/78 X |
| 4,655,190 | 4/1987 | Harris | 124/78 |

FOREIGN PATENT DOCUMENTS

| | | | |
|---|---|---|---|
| 0019311 | 11/1984 | European Pat. Off. . | |
| 2262880 | 6/1974 | Fed. Rep. of Germany | 124/78 |
| 3210828 | 10/1983 | Fed. Rep. of Germany . | |
| 3248802 | 10/1983 | Fed. Rep. of Germany . | |
| 2587473 | 3/1987 | France . | |
| 2095565 | 10/1982 | United Kingdom . | |
| 2116954 | 10/1983 | United Kingdom . | |
| 2142546 | 1/1985 | United Kingdom . | |

*Primary Examiner*—Randolph A. Reese
*Assistant Examiner*—Harry C. Kim
*Attorney, Agent, or Firm*—Wenderoth, Lind & Ponack

[57] ABSTRACT

In a tennis-ball throwing device, tennis balls are conveyed by a feed device into a cavity between two rollers mounted so that their axes are parallel, the balls being subsequently ejected by rotation of the rollers. One roller is mounted on a rocking lever that can be pivoted against the restoring force of a spring. A spindle or axis of the rocking lever is mounted parallel to the axes of the rollers on a pivoting carrier for the rollers.

9 Claims, 3 Drawing Sheets

BALL THROWING DEVICE FOR TENNIS BALLS

BACKGROUND OF THE INVENTION

The invention relates to ball throwing device for tennis balls, which are conveyed by a feeder into the space between two rollers mounted on parallel axes and are ejected by rotating the rollers. Both rollers are disposed on a carrier which can be swivelled in the plane of the rollers, i.e. transverse to the axes, and the spacing of the axes of the rollers is variable.

To the extent that such devices have been described to date, e.g. in DE-A1-32 10 828, such description leaves totally open the manner by which the spacing of the axes of the rollers can be varied.

SUMMARY OF THE INVENTION

The invention proceeds from the assumption that balls of different diameter are supplied in an uncontrolled manner into the ball throwing device. The object of the invention is to ensure that the device is automatically adapted to the respective diameters of the balls. Thus, the device neither will be blocked by large balls nor will it eject small balls significantly less far than large balls.

The object is achieved according to the invention by mounting one roller on a rocking lever that can be swivelled against the force of a spring about a swivel axis that extends parallel to the axes of the rollers and that is mounted on the swivelable carrier. If children's balls and standard balls alternatingly are supplied into such a device, it readily can be achieved by hinging the spring at suitable points that the forces exerted on the balls do not differ substantially and that thus even quite different balls are ejected equally far.

In expensive ball throwing devices for adults, the rollers serving to eject the balls are driven separately so that a spin or twist can be imparted to the balls owing to different speeds of rotation of the rollers. In machines intended primarily for children, it is desirable in the sense of a simple construction to drive only one roller, which also drives the second roller by way of a friction lining along the circumference thereof. This feature seems at first to be incompatible with the proposal of the invention since, when the roller mounted on the rocking lever is swung outwardly to accommodate a ball, such roller is lifted from the drive roller. However, it is actually true that the ball pushing apart the two rollers rests in this situation against the two rollers under so much pressure that the ball takes with it the non-driven roller friction-lockingly.

BRIEF DESCRIPTION OF THE DRAWINGS

Other features of the invention are explained below with reference to the accompanying drawings, wherein.

DETAILED DESCRIPTION OF THE INVENTION

Figure 1:
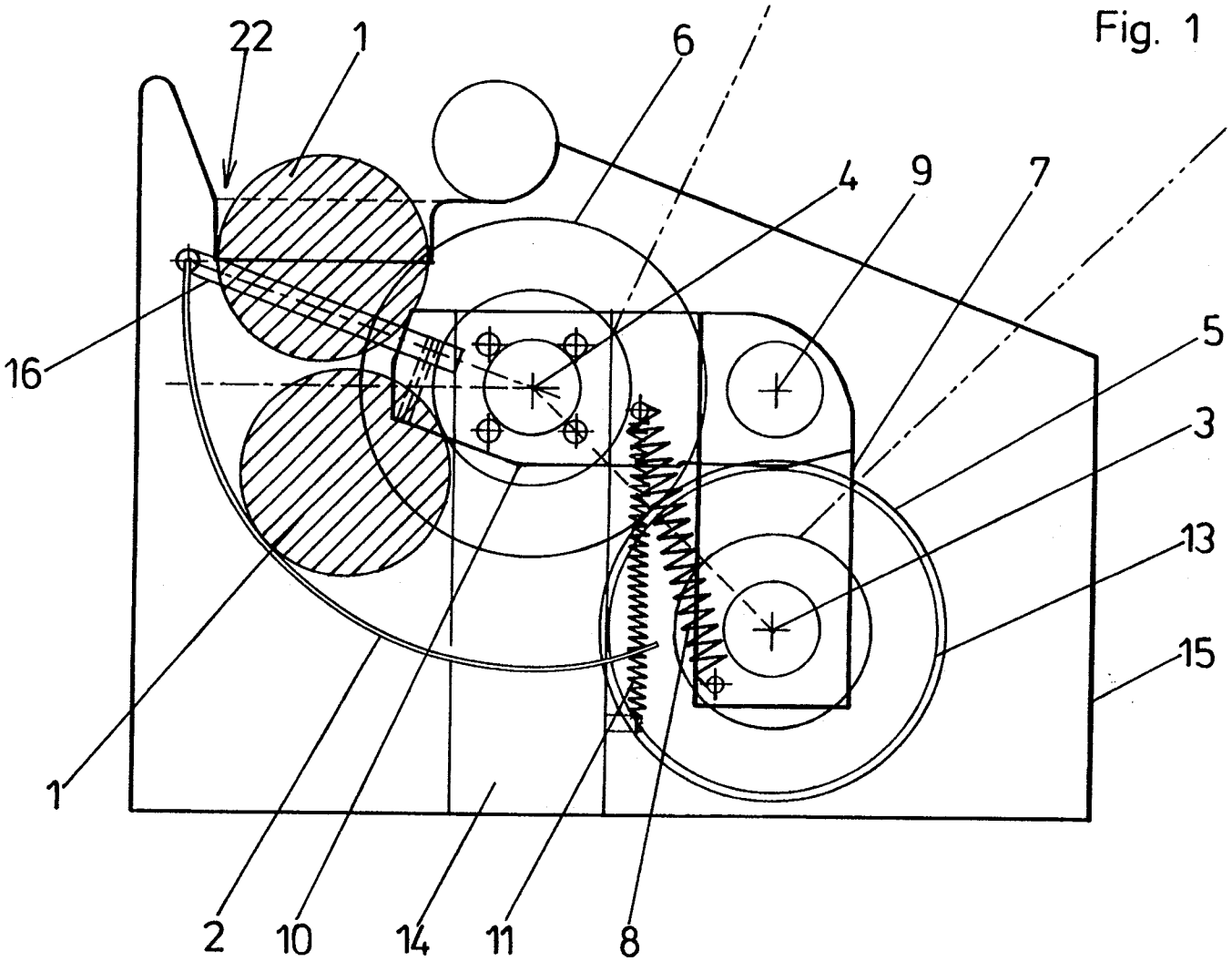
FIG. 1 is a schematic side view of an embodiment of the invention.
Figure 2:
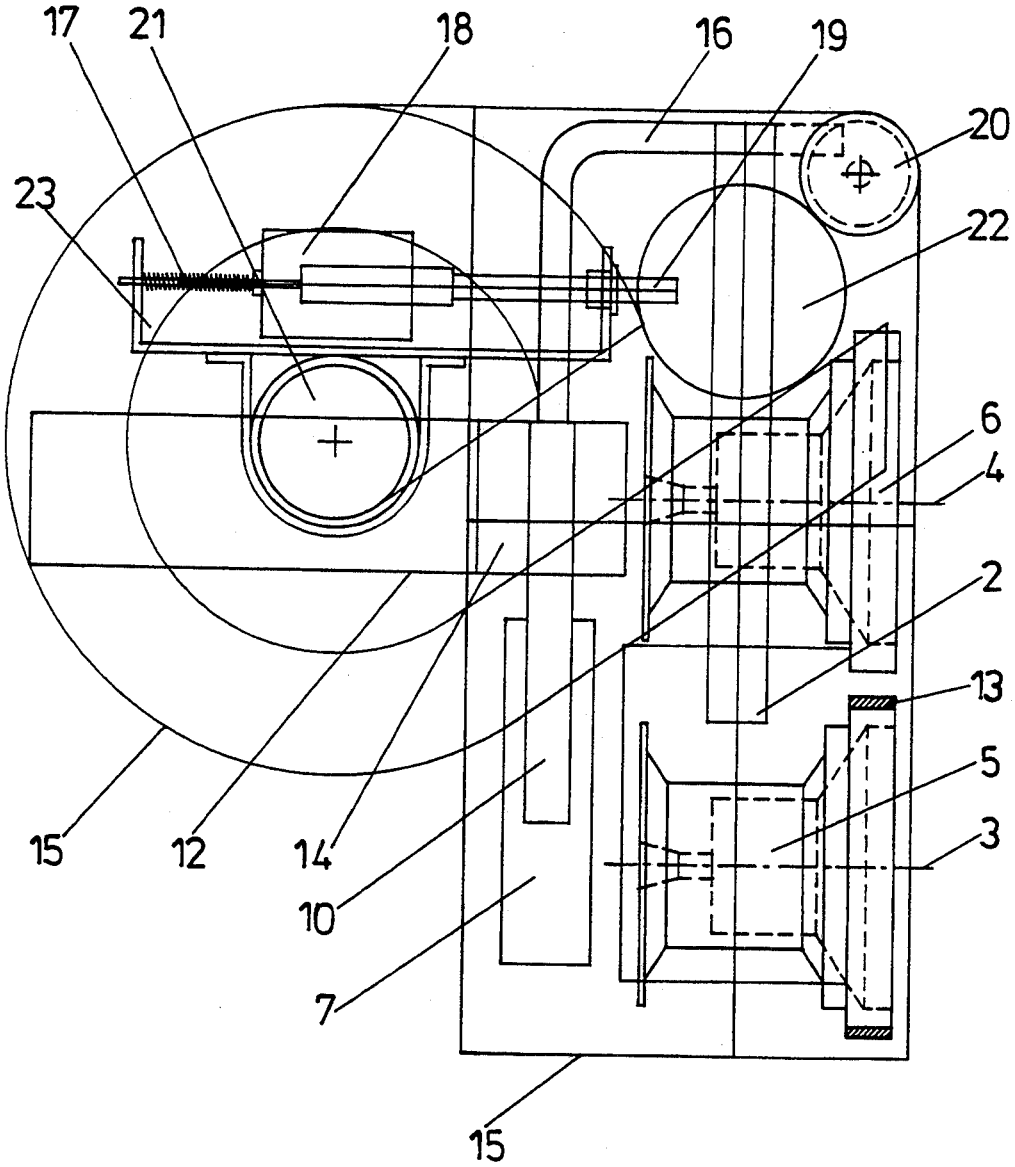
FIG. 2 is a corresponding top view with rollers shown forced apart.

The device shown in FIGS. 1 and 2 includes a frame, of which only a supporting column 14 is shown in detail. A carrier or carrier member 10 which can be swivelled around an axis or shaft 4 is attached to the supporting column 14. Carrier 10 in turn bears a pivot or swivel axis or shaft 9 for a rocking lever 7. Rollers 5 and 6, exhibiting a construction typical of ball throwing devices, respectively are mounted on an axis or shaft 3 supported by rocking lever 7 and on axis or shaft 4 coaxially to the carrier 10. By swivelling the carrier 10 against the effect of a return spring 11, the inclination of a connecting line between axes 3 and 4 can be changed, thus resulting in steeper or flatter ejection of the balls as desired. The carrier 10 is swivelled by exerting, by way of a handle 20 and a stop which can be threadably adjusted, pressure on a cross piece 16 connected to the carrier 10. If balls 1 are fed into the space between the rollers 5 and 6, as in the illustrated case by rolling along a sheet metal chute or bracket 2, then it is expedient to connect this sheet metal bracket to the cross piece 16 so that it does not change its position relative to the rollers 5 and 6 even when the carrier 10 is swung outwardly.

The core of the ball throwing device described above is enclosed by a housing 15 including an upper side having a filling opening 22 for supplying of the balls 1. A supply container for the balls can be attached above the filling opening 22, such supply container preferably having the shape of a wire spiral through which the balls push forward toward the bottom.

In the interior of the housing 15 is a supporting journal 21 to which is flanged a support bracket 23. A stop pin 19, which can be pulled back against the action of a spring 17 from the path of the balls 1 by means of an electromagnet 18, is attached to support bracket 23. Thus, it is ensured that the balls 1 move individually at the desired time interval by way of the sheet metal bracket 2 into the ejection region between rollers 5 and 6.

A motor 12 is arranged coaxially to the roller 6 and serves to drive rollers 5 and 6. There is no rigid coupling between the shaft of the motor and the axis 4, in order to preserve the bearings of the motor. Motor 12 directly drives roller 6, and roller 5 is driven in that the rollers 5 and 6 make contact along their circumference, and a friction lining 13 on roller 5 engages roller 6 and causes driving or taking along of the roller 5.

Figure 3:
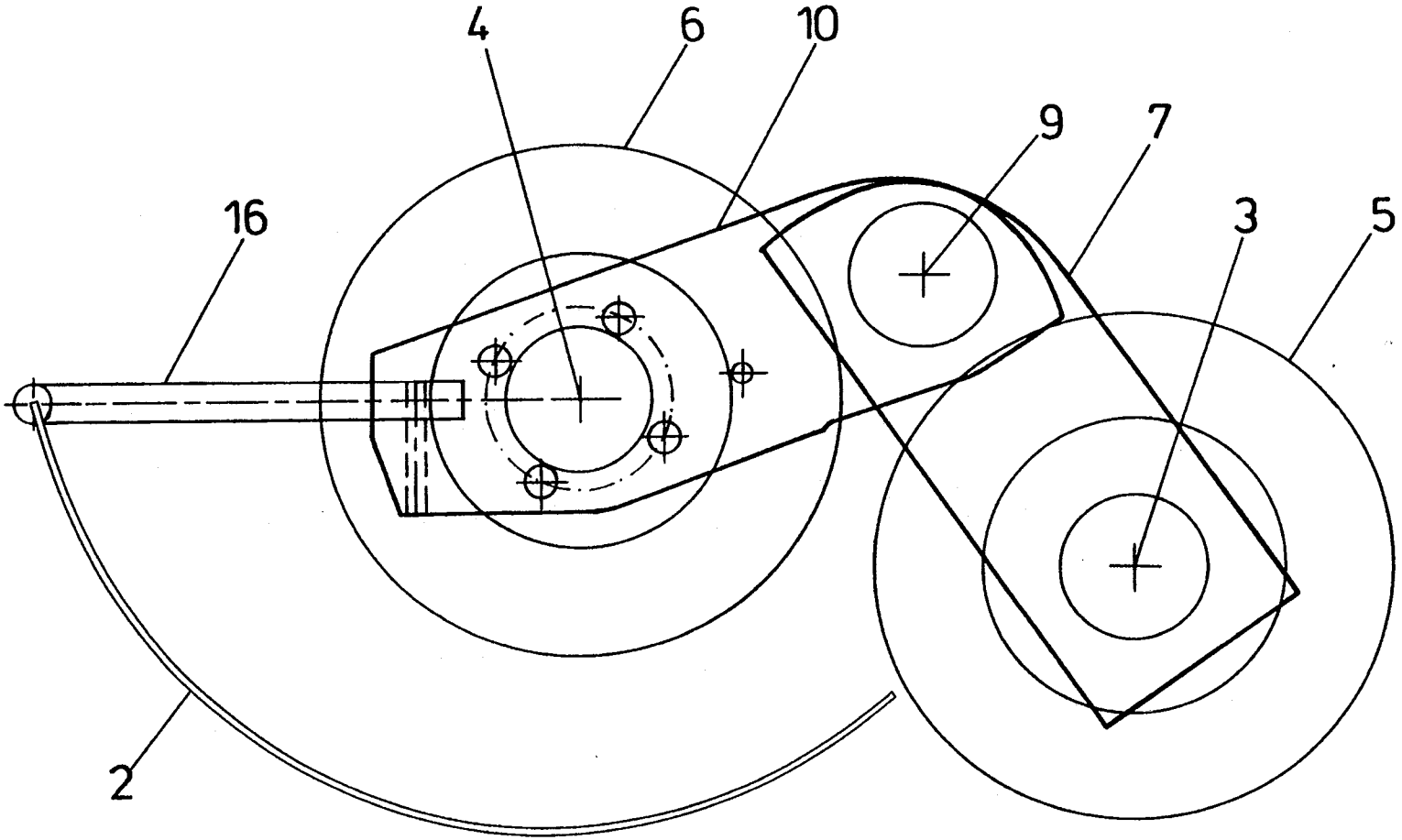
FIG. 3 is an enlarged side view of those parts essential to the invention, also shown with the rollers forced apart.

Important for the invention is a spring 8, which not only presses the roller 5 friction-lockingly against the roller 6, but above all also allows a ball to pass between the rollers 5 and 6 and to be properly ejected. If a larger ball is supplied between the rollers 5 and 6, the device moves into the position which is shown in FIGS. 2 and 3 and in which the axes 3 and 4 are forced apart further against the resistance of the spring 8. At the same time the circumferences of the rollers 5 and 6 disengage. However, in this situation the ball passing between rollers 5 and 6 assumes the transfer of force of drive from roller 6 to roller 5.

With the device of the invention, there is provided a simple construction suitable above all for use for children but that also can be used to eject normal balls. Further, the occasional use of such normal balls does not present a problem.

I claim:

1. A ball throwing device capable of automatically accommodating and throwing balls of different diameters, said device comprising:

a carrier member supporting a first roller for rotation about a first axis;

a rocking lever pivoted to said carrier member about a pivot axis parallel to said first axis and supporting a second roller for rotation about a second axis parallel to said first axis;

a motor mounted to directly drive only one said roller;

a spring mounted to urge said rocking lever to pivot about said pivot axis in a first direction to urge said second roller toward and into friction contact with said first roller such that drive of said one roller is transferred to the other said roller due to said friction contact therebetween;

a ball feeder to feed a ball to a region between said rollers such that rotation of said rollers throws the ball; and the passage of the ball between said rollers urging said second roller away from said first roller and pivoting said rocking lever against the force of said spring in a second direction opposite to said first direction, during which said drive of said one roller is transferred to said other roller by the ball therebetween.

2. A device as claimed in claim 1, further comprising a frame, said carrier member being supported on said frame for selective swivel adjustment relative thereto about a swivel axis.

3. A device as claimed in claim 2, wherein said swivel axis and said first axis are coaxial.

4. A device as claimed in claim 2, further comprising a return spring urging said carrier member about said swivel axis.

5. A device as claimed in claim 2, wherein said motor includes a drive shaft coaxial to said swivel axis.

6. A device as claimed in claim 1, further comprising a friction lining on a circumference of one said roller.

7. A device as claimed in claim 6, wherein said friction liming is on said second roller.

8. A device as claimed in claim 1, wherein said motor directly drives said first roller.

9. A device as claimed in claim 1, wherein said motor includes a drive shaft coaxial to the directly driven said one roller.

* * * * *